US006983692B2

(12) United States Patent
Beauchamp et al.

(10) Patent No.: US 6,983,692 B2
(45) Date of Patent: Jan. 10, 2006

(54) PRINTING APPARATUS WITH A DRUM AND SCREEN

(75) Inventors: Robert W. Beauchamp, Carlsbad, CA (US); Arthur Henschel, Lakeside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/699,447

(22) Filed: Oct. 31, 2003

(65) Prior Publication Data

US 2005/0092200 A1 May 5, 2005

(51) Int. Cl.
*B41F 21/10* (2006.01)
*B65H 29/24* (2006.01)

(52) U.S. Cl. ..... 101/409; 101/389.1; 101/487; 492/32; 492/46; 271/276; 271/309

(58) Field of Classification Search ..... 101/389.1, 101/415.1, 407.1, 409, 246, 487, 488, 424.1; 492/28, 30, 32, 46; 271/275, 276, 307, 309, 271/194, 195, 900; 347/104; 399/323, 398
See application file for complete search history.

(56) References Cited

U.S. PATENT DOCUMENTS 4,856,428 A * 8/1989 Green et al. ..... 101/475
4,998,658 A * 3/1991 Distefano et al. ..... 226/95
5,137,758 A * 8/1992 Kistner et al. ..... 427/350
5,553,543 A 9/1996 Takahashi et al.
5,802,434 A 9/1998 Takehara et al.
6,074,056 A 6/2000 Kubo et al.
6,174,045 B1 1/2001 Kerr et al.
6,203,135 B1 3/2001 Murcia et al.
6,205,924 B1 3/2001 Kamano
6,299,301 B1 10/2001 Baek et al.
6,309,063 B1 10/2001 Kamano et al.
6,313,859 B1 11/2001 Kerr et al.
6,328,411 B1 12/2001 Taylor et al.
6,357,869 B1 3/2002 Rasmussen et al.
6,460,991 B1 10/2002 Temple et al.
6,581,517 B1 * 6/2003 Becker et al. ..... 101/389.1
2002/0008727 A1 1/2002 Taylor et al.
2002/0085054 A1 7/2002 Tokie
2002/0085056 A1 7/2002 Yitalo
2002/0130909 A1 9/2002 Wojcik et al.

FOREIGN PATENT DOCUMENTS

DE 25 09 680 A1 * 9/1976
JP 8-230261 * 9/1996

OTHER PUBLICATIONS

European Search Report for Application No. EP 04256491, filed Oct. 21, 2004. (search completed Feb. 16, 2005).

* cited by examiner

*Primary Examiner*—Leslie J. Evanisko

(57) ABSTRACT

A printing apparatus includes a drum having a peripheral surface having passageways therein. A screen having apertures therein is placed over the peripheral surface of the drum.

30 Claims, 6 Drawing Sheets

PRINTING APPARATUS WITH A DRUM AND SCREEN

BACKGROUND

There are many types of printing mechanisms. One type of printing mechanism includes a drum for handling media. Positioned near the drum are one or more printheads that place ink on the media as the media is moved through a print zone. The media is held on the drum using a vacuum that holds the print medium onto the drum. In operation, a sheet is fed to the rotating drum by a sheet feeder, and the vacuum captures it and rolls it on to the drum. As the drum and media rotate, the media passes one or more printheads that print on the paper with as many revolutions as is necessary. After the leading edge of the media passes the printhead, or last printhead, on its last pass, an ejector is used to remove the media from the drum. As soon as the trailing edge of the media has passed the sheet feeder, the next sheet of media is fed on to the drum. Difficulties exist in separating the media from the drum after placing the ink on the media.

DETAILED DESCRIPTION

In the following detailed description of the embodiments, reference is made to the accompanying drawings that form a part hereof, and in which are shown by way of illustrating specific embodiments in which the invention may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of present inventions. The following detailed description, therefore, is not to be taken in a limiting sense, and the scope of various embodiments of the invention is defined only by the appended claims, along with the full range of equivalents to which such claims are entitled.

Figure 1:
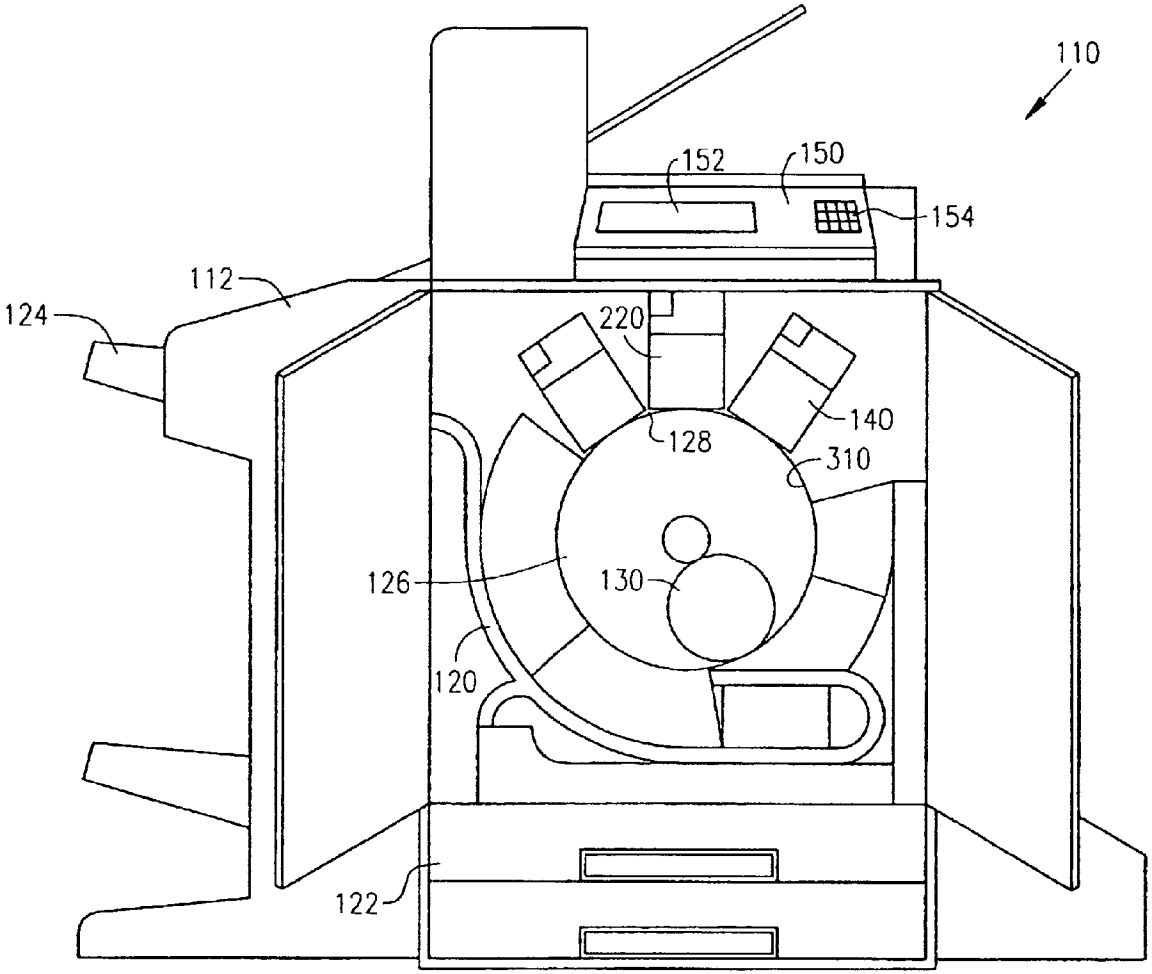
FIG. 1 is a simplified front view of a printing apparatus according to one embodiment of the invention.

FIG. 1 shows one embodiment of a printing device according to one embodiment of this invention. FIG. 1 includes a printing apparatus 110, that includes a chassis 112 and a print media handling system 120 for supplying a print media. The print media handling system 120 includes at least one media input tray 122, a media output tray 124 and a media or paper path 126. The media or paper path 126 includes a series of rollers 130 that position the paper to receive ink from an ink source 140. In addition to the rollers 130, the media or paper path includes a print drum 310. The print drum 310 moves the media into a print zone 128. The ink source 140 is positioned near the print drum 310 in the print zone 128. In this embodiment, the ink source 140 includes a plurality of ink jets 220 positioned around a portion of the print drum 310. It should be understood that the ink source 140 is not limited to a plurality of ink jets and could be any other source of ink or fluid, such as toner cartridge or other source of ink or fluid. Furthermore, the print media used includes any type of suitable sheet material, such as paper, photo-quality paper, card-stock, transparencies, mylar, foils, and any other similar print media. The printing apparatus also includes a control panel 150. The control panel includes a display 152 and a keypad 154 for inputting commands to the printing apparatus 110. Parameters related to a print job are displayed on the display 152. Selections are made at the keypad 154. After a selection is made, the result is displayed on the display 152. The location and configuration of the control panel may vary.

Figure 2:
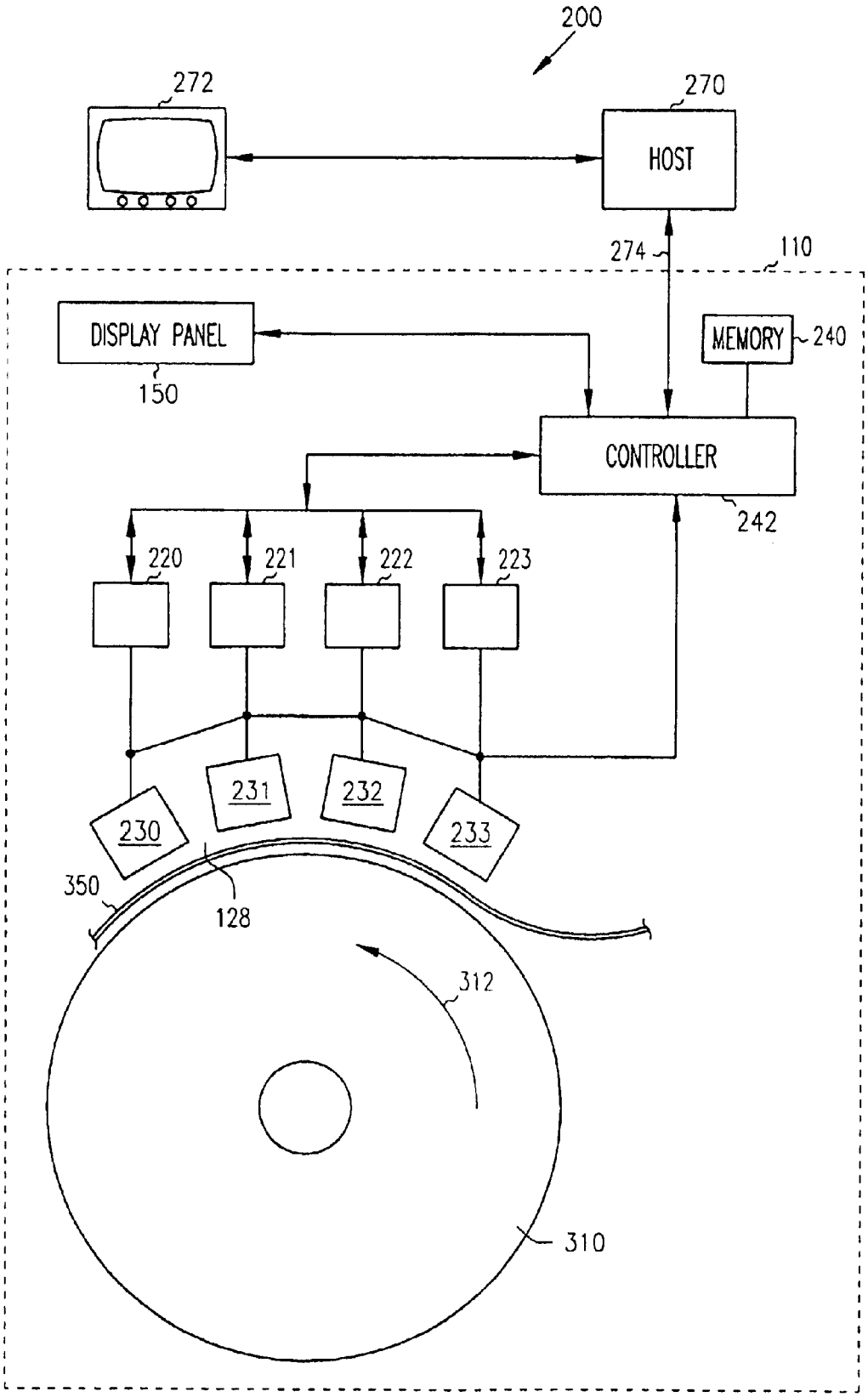
FIG. 2 is a schematic view of a printing apparatus that includes the printer controller and a host computer according to an embodiment of the invention.

FIG. 2 is a schematic view of a printing apparatus 200 that includes the printing apparatus 110 with a printer controller 242, according to an embodiment of the invention. A host computer 270 is attached to the printing apparatus 110. The controller 242 generally receives instructions from the host computer 270, such as a personal computer. A monitor or display 272 coupled to the host computer 242 is used to display visual information to an operator, such as the printer status or a particular program being run on the host computer 270. Screens on the monitor or display 272 are one form of user interface to the printing apparatus 110.

The controller 242 controls many aspects of the printing apparatus 10. A memory 240 is attached to the controller 242. The host computer 270 is also attached to the controller 242. A display 272 is also attached to the host computer 270. The display 272 is associated with the host computer 270 and displays screens associated with the type of hardware and software associated with the host computer 270. The display 272 is different from the display 152 of the display panel 150 of the printing apparatus 10. The display 152 of the display panel 150 generally displays messages related to the printing apparatus 110.

The controller 242 is communicatively coupled to a host computer 270. The host computer 270 is shown connected to a display device 272. The host computer 270 can be a variety of information sources such as a personal computer, work station, or server, to name a few, that provide image information to the controller 242 by way of a data link 274. The data link 274 may be any one of a variety of data links such as an electrical link, radio frequency link, or an infrared link. The data link transfers information between the host computer 270 and the printing apparatus 10. The controller 242 controls the transfer of information between the host computer 270 and a plurality of printheads 230, 231, 232 and 233 in the print zone 128 of the printing apparatus. The controller, in some embodiments of the invention, can monitor ink type and ink color in a plurality of reservoirs 220, 221, 222, and 223. The controller 242 also controls many other aspects of the printing apparatus 110, such as the speed of rotation of the print drum 310. A media 350 is shown as temporarily attached to the print drum 310.

Figure 3:
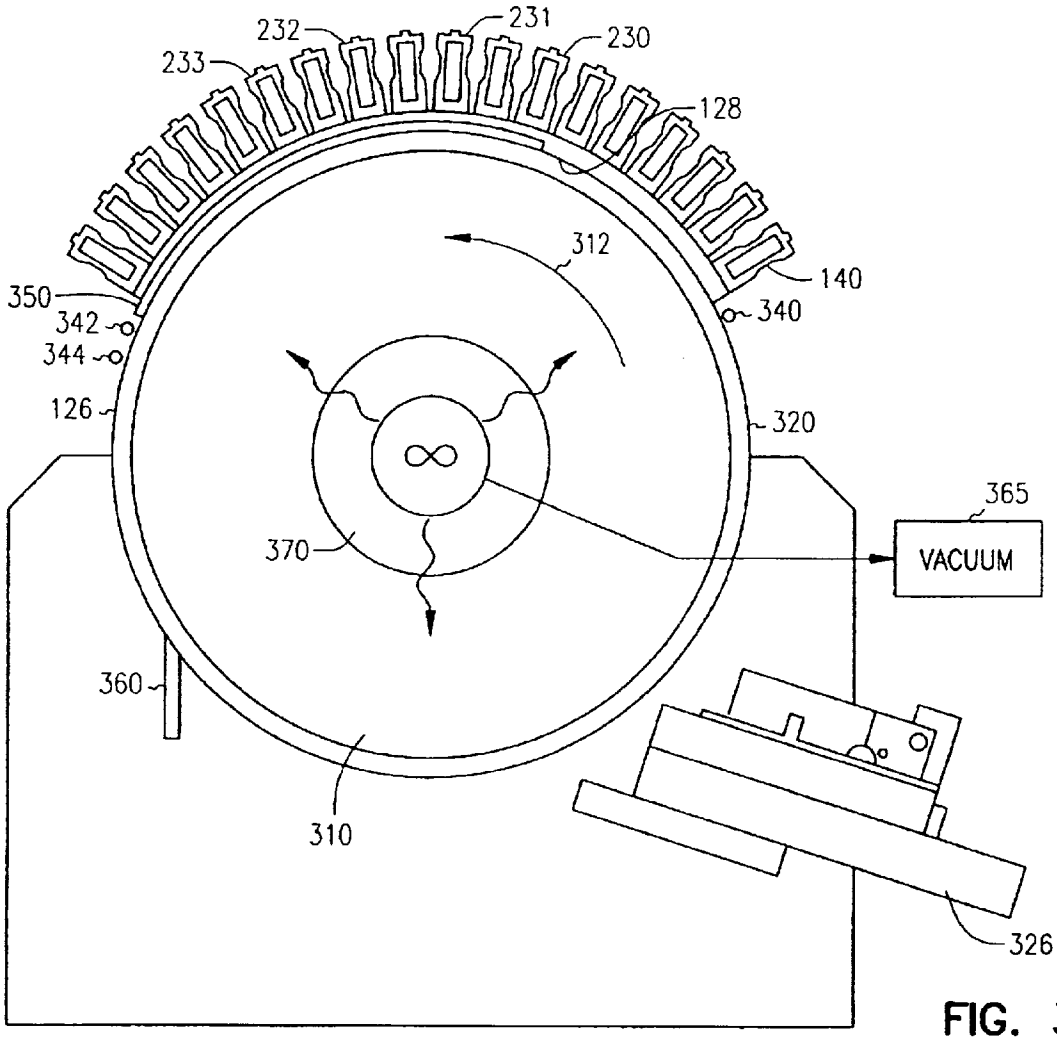
FIG. 3 is a schematic view of a print drum and the paper path of the printing apparatus according to an embodiment of the invention.

FIG. 3 is a schematic view of a print drum 310, and a portion of the paper path 126 according to an embodiment of this invention. As shown in FIG. 3, there is a plurality of printheads located near the outer peripheral surface of the print drum 310. The printheads include printheads 230, 231, 232, and 233 as well as other printheads. All the printheads, which place the ink onto a medium, or paper, form the ink source 140. All the printheads are located within the print zone 128. The portion of the paper path 126 includes a media feeder 326, which loads media onto the print drum 310 along the paper load area, depicted by the reference numeral 320 on the area of the drum downstream from the media feeder 326. The print drum 310 rotates in a direction depicted by arrow 312.

The print drum 310 and the printing apparatus include several sensors. First of all, there is a top of form ("TOF") sensor 340 which is a senses when the incoming media enters the print zone. The signal from the TOF sensor 340 feeds a signal back to the controller 242 (shown in FIG. 2). The TOF sensor is located upstream of the print zone 128. There is also a media load sensor 342. The media load sensor shows that there is paper or a medium 350 on the outer surface of the print drum 310 downstream from the print zone 128. The media load sensor 342 indicates that a media is on the outer peripheral surface of the print drum 310.

Located adjacent the media load sensor 342 is a media pick-off sensor 344. The media pick-off sensor 344 senses the presence of the paper. In some instances, the paper or media 320 stays on the print drum for a single pass. In other instances, the paper or media stays on the print drum 310 for multiple passes. The media pick-off sensor 344 senses the presence of the paper or media 320 for a single pass or a multiple pass. The media pick off sensor inputs this information to the controller 242 (shown in FIG. 2). The controller 242 enables a media pick-off when the media is to be picked off, or removed, from the surface, or outer peripheral surface of the print drum 310. The controller 242 (shown in FIG. 2) moves the media pick-off 360 into position to remove the media from the print drum 310, and specifically from the surface of the print drum 310 (shown in FIGS. 2 and 3).

If the media pick-off 360 is not enabled, the media 350 stays attached to the drum for one or more additional rotations. In other words, media 350 can be on or remain on the surface of the drum 310 in the event multiple passes are needed in order to accomplish a particular print job. The print drum also includes a source of vacuum 365. The vacuum 365 produces a vacuum at the peripheral surface of the drum 310. Also located within the print drum 310 is a source of radiant heat 370. The source of heat 370 is used to dry or partially dry any ink that is laid down or placed on the media 350 which is located on the outer peripheral surface of the print drum 310. In this particular embodiment, the media pick-off 360 includes an air jet, or a device which produces a stream of high-pressure, high-volume air which can be directed at the surface of the print drum 310.

Figure 4:
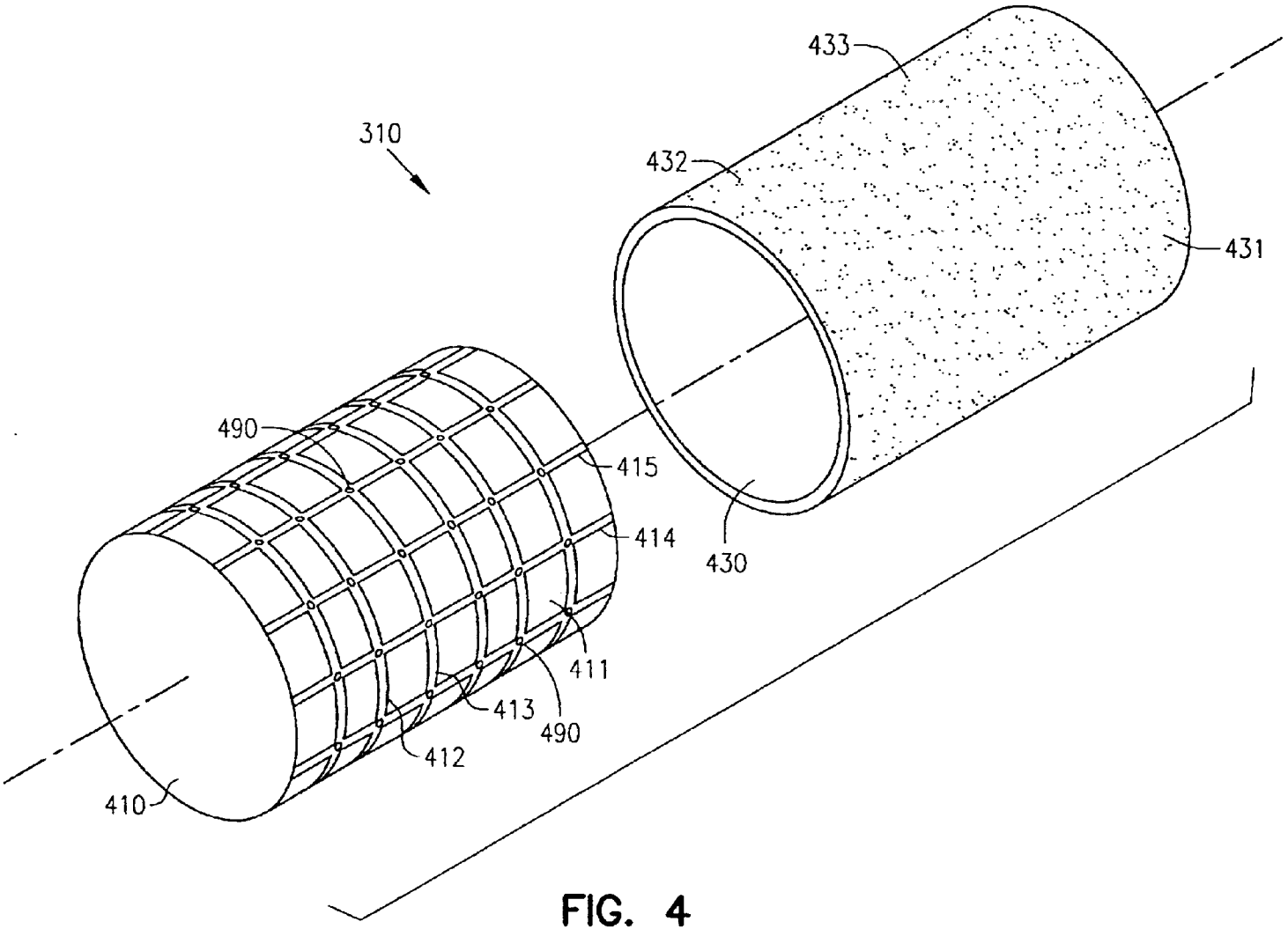
FIG. 4 is an exploded perspective view of the print drum and the screen according to an embodiment of the invention.

FIG. 4 shows an exploded view of the print drum 310. The print drum 310 includes a vacuum drum portion 410, and a screen portion 430. The screen portion 430 is dimensioned to fit over an outside or peripheral surface 411 of the drum 410. The drum includes a series of channels, such as channel 412 and channel 413, which are circular channels which pass over the outer or peripheral surface of the drum 410. The drum also includes longitudinal channels, such as 414 and 415. The drum 410 includes openings which occur at the intersections of the circular channels 412, 413 and the longitudinal channels 414, 415. The openings pass through the drum to the vacuum source 365 (as shown in FIG. 3). The channels, such as 412, 413, 414, 415, and the openings, such as opening 490, at the intersections of the various channels, form passageways that distribute the vacuum over the peripheral or outer surface 411 of the drum 410. The vacuum 365, and especially the channels 412, 413, 414, 415 and openings 490 distribute the vacuum over the surface of the drum so that media, or paper, such as 350 shown in FIG. 3, are temporarily attached to the drum by the vacuum during the print job. The vacuum source 365 acting throughout the channels such as 412, 413, 414, 415 and openings can be maintained so that the media 350 (shown in FIG. 3), stays on print drum 310 for single or multiple passes through the print zone 128 (shown in FIGS. 2 and 3).

The screen or cover 430 which covers the outer peripheral surface 411 of the drum 410 serves to distribute heat from the radiant heat source 370. The screen 430 is made of a heat-conducting material so that heat from the heat source 370 is distributed substantially evenly over the outside surface of the drum which corresponds to the peripheral surface 431 of the screen 430. The screen 430 or covering, as shown in FIG. 4, includes a plurality of apertures, such as 432, 433 that are placed over the entire peripheral surface 431 of the covering or screen 430. Each dot shown on the screen 430 represents an aperture. The apertures 432, 433 are sufficient to allow the vacuum from the channels 412, 413, 414, 415 to act through the apertures 432, 433. The vacuum can then be transferred through the screen or through the covering 430 so that paper or medium 350 (shown in FIGS. 2 and 3) remains on the surface 431 of the screen or covering 430. The screen or covering 430, according to some embodiments, has a sufficient amount of material so that the channels, such as 412, 413, 414, 415 are spanned and heat is distributed substantially evenly over the surface 431 of the screen or covering 430. In some embodiments, the openings 432, 433 in the screen are small enough so that a substantial amount of material spans the channels 412, 413, 414, 415 associated with the air passageways to prevent uneven heating along the peripheral surface 411 of the print drum 310 between the solid portions and the channels 412, 413, 414, 415. The apertures 432, 433 in the screen 430 are also sufficient to allow the pick-off device 360 (shown in FIG. 3) to direct a stream of air toward the surface 431 of the cover or screen 430 and allow air to pass to the surface 411 of the outer drum 410. It should be noted that the screen or cover 430 is made of a material which is thermally compatible with the drum 410. In some embodiments, the screen 430 is made of a material having a coefficient of thermal expansion which is substantially similar to the coefficient of thermal expansion associated with the vacuum drum portion 410 so that thermal mismatches will be either reduced or will not occur. In some embodiments, the screen material has a coefficient of thermal expansion within the range of 1.0 to 30.0 micrometers/meter/degree Centigrade. In some other embodiments, the screen material has a coefficient of thermal expansion within the range of ten percent less than a coefficient of thermal expansion of the drum material and ten percent greater than the coefficient of thermal expansion of the drum material. In some embodiments, the cover or screen 430 may be made of the same material as the vacuum drum portion 410. Therefore, the screen 430 and the vacuum drum portion 410 would have the same coefficient of thermal expansion.

Figure 5:
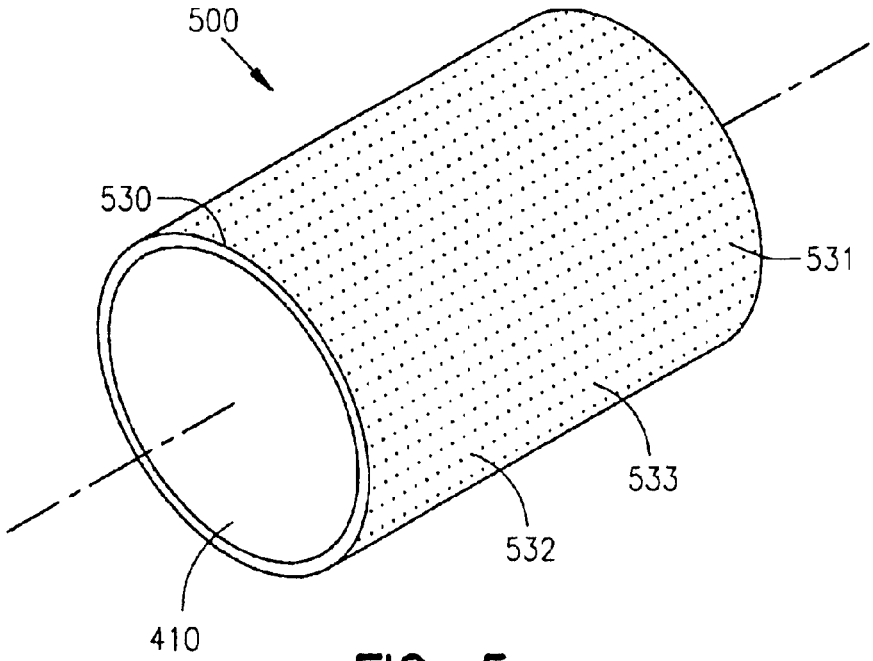
FIG. 5 is an assembled view of the print drum and the screen and a nozzle for directing air or another gas toward the ejection channels of the print drum according to an embodiment of the invention.

FIG. 5 shows print drum 500 according to another embodiment of this invention. In this particular embodiment, the print drum includes a vacuum drum portion 410 which has a screen 530 thereon. The vacuum drum portion 410 and the screen 530 are made of materials which have substantially the same coefficient of thermal expansion. This prevents thermal mismatches from occurring when the source of heat or radiant energy within the drum 370 (shown in FIG. 3) heats the vacuum drum portion 410 and the screen 530. The screen includes a series of apertures 532, 533 that extend through an outer surface 531 of the screen 530. The apertures 532, 533 in the screen 530 are 0.3 mm in diameter, in one embodiment, although the size and shape of the openings may vary. The apertures, such as apertures 532, 533, may be evenly distributed over the screen 530 in the embodiment shown in FIG. 5. The amount of material that remains as part of the cover or screen is sufficient to span the channels 412, 413, 414, 415 (shown in FIG. 4) of the vacuum drum portion 410 and to allow heat to be distributed evenly over the surface 531 of the screen 530. In other words, there is an amount of material 530 on the screen or covering that allows the screen 530 to span the channels 412, 413, 414, 415 (shown in FIG. 4) and yet allow an even thermal distribution of the radiant heat coming from the radiant heat source 370 from within the drum 410. The openings in the screen 530 also allow for an airstream type pick-off to force air to the surface 411 (shown in FIG. 4) of the vacuum drum portion 410 to effectuate a removal of print medium 350 (shown in FIGS. 2 and 3) from the surface of the screen 531.

It should be noted that in some embodiments of the invention, the channel pattern forms a grid over the surface 411 of the print drum 410. Although the width, shape, and depth of the channels may vary, in an example embodiment, the channels have a width of approximately 1 millimeter. As a result, the openings in the barrel through which the vacuum is drawn which occur at the intersections of channels 412, 413 and grooves 414, 415 are also on 20–25 millimeter centers. The material which forms the screen 430, 530, in some embodiments, is 0.3 mm thick. One type of material is called Invar which is available from Belt Technologies, Inc. at Agawam, Mass. At temperatures typical of some of the example embodiments, Invar has a low, almost negligible, coefficient of thermal expansion.

Figure 6:
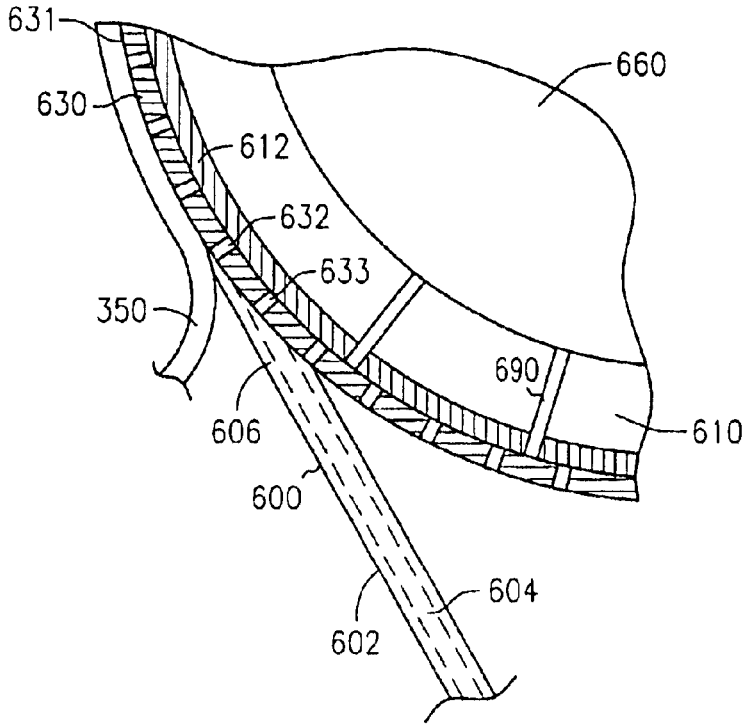
FIG. 6 is a cross sectional schematic diagram illustrating a pick-off shovel for removing paper from the surface of a drum according to an embodiment of the invention.
Figure 7:
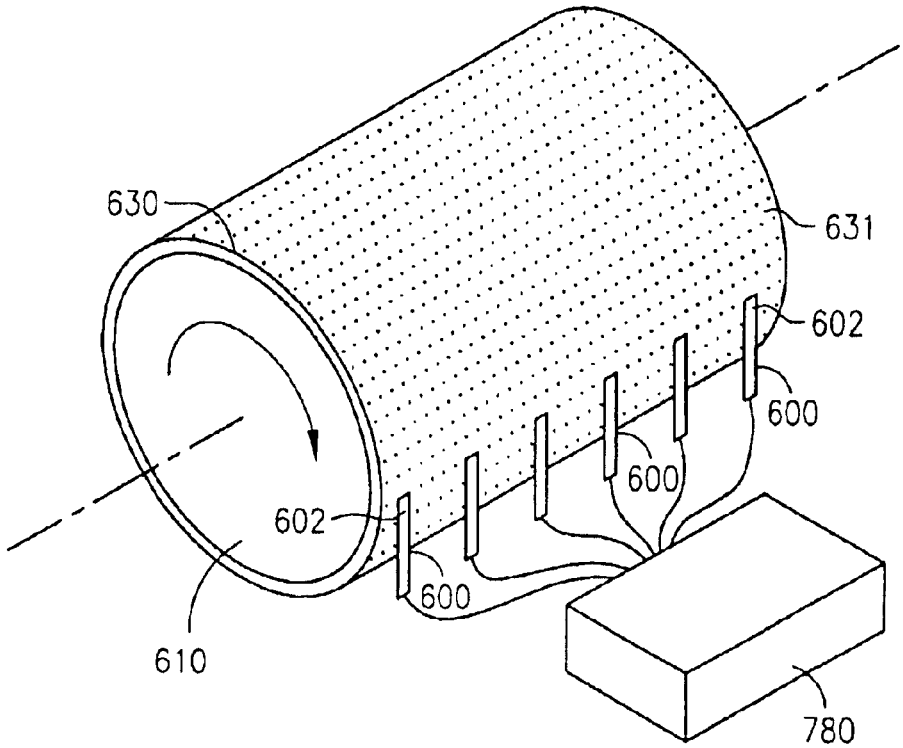
FIG. 7 is a schematic diagram illustrating a plurality of pick-offs positioned near the surface of a screen of a drum according to an embodiment of the invention.

FIG. 7 is a schematic diagram illustrating a plurality of media ejectors or pick-offs 600 positioned near the surface 631 of a screen 630 of a drum 610 according to an embodiment of the invention. Each of the media ejectors or pick-offs 600 is positioned near a circumferential channel 612 of the drum 610 Channels 612 are in communication with a vacuum chamber 660 via passages 690. Each of the media ejectors or pick-offs 600 is in fluid communication with a source of pressurized gas 780, such as air. Any type of pressurized gas may be used, although the example set forth here discusses the use of air. FIG. 7 is illustrated without media on the surface 631 of the screen 630 of the drum, for the sake of clarity. FIG. 6 is a cross sectional schematic drawing detailing a single pick-off or media ejector 600 for removing media 350 from the surface 631 of a screen 630 on the drum 610. Now looking at both FIGS. 6 and 7, the media ejection and pick-offs for removal of media 350 from the surface 631 of the screen 630 of the drum will be discussed. The media ejector or pick-off 600 includes a shovel portion 602 and an air tube or conduit 604. The pick-off 600 includes an internal cavity to allow an air tube 604 to pass down the length of the media ejector or pick-off 600 and through the shovel portion 602. The air tube or conduit 604, therefore, terminates near an end 606 of the pick-off 600 which is near the surface 631 of the screen 630 on the print drum 610. The end 606 of the pick-off or media ejector is typically positioned so that the air tube or conduit 604 passing down its length of the pick-off or media ejector 600 directs a stream of air through apertures 632, 633 in the screen 630 and into a channel 612 on the drum 610. The pick-off or media ejector 600 is actually positioned near the cover layer 630 and paper is removed from the drum 610 by blowing air into the circumferential channel 612 on the drum 610. The air is directed through the apertures 632, 633 in the screen 630. The end 606 of the air tube 604 does not extend into the screen 630. Therefore, the screen also prevents the shovel portion 602 of the media-ejector or pick-off 600 from reaching below a lower surface of the paper 350 held onto the cover 630 of the drum 610.

The air from the air tube or conduit 604 enters the channel 612 through the apertures 632, 633. Raising the pressure along the channel 612 lifts the paper off the cover 630 upstream from the air tube or conduit 604 of the pick-off 600. The pressurization along the channel 612 by the air passing through the air tube or conduit 604 results in an increase in the air pressure within the channel 612 that causes separation of the media 350 from the cover 630 upstream from the shovel portion 602. After the leading edge of the media 350 separates from the cover 630, the shovel portion 602 slides below the media 350 so it can then be completely separated from the screen 630 on the drum 610. In one embodiment, the channel 612 corresponds to one of the air passageways that transmit a vacuum from the drum 610 to the media (see discussion in FIG. 4). In one embodiment, the source of vacuum is disabled before the media 350 is to be removed from the surface 631 of the screen 630. In still other embodiments, there are a plurality of pick-offs or media ejectors 600 that pressurize a plurality of circumferential channels, such as channel 612, in the drum 610 to remove the media 350 from the screen 630. In some embodiments, a plurality of media ejection channels separate from the air passageways are pressurized to remove the media 350.

Use of some embodiments of the present invention may result in fewer paper crashes using the pick-off or media ejector 600 which includes the shovel portion 602 and the air tubes or conduits 604. Some embodiments may allow for separation of a wider range of paper or media weights and may do so in a more gentle, less abrasive way. As a result of using some embodiments of the present system and method for removing paper from the paper or media 350 from the screen 630 on the drum 610, the integrity of the media is maintained which is especially important for duplex printing. In addition, pressurizing the media from below through a plurality of channels such as 612, avoids touching the freshly printed or inked surface of the media 350. Thus, using embodiments of this system may result in fewer ink smears on the printed surface of the print medium or paper 350.

In conclusion, some embodiments of a printing apparatus include a print drum having a peripheral surface. The peripheral surface of the print drum has air passageway openings therein. A screen is placed over the peripheral surface of the print drum, the screen having openings therein that are smaller than the air passageway openings of the peripheral surface of the print drum. The printing apparatus also includes a heat source for heating the peripheral surface of the print drum and the screen. At least a portion of the heat source is located inside the print drum. The printing apparatus also includes a vacuum source. The vacuum source is in fluid communication with the air passageway openings on the peripheral surface of the print drum. At least a portion of the vacuum source is inside the print drum.

In some embodiments, the air passageway openings in the print drum include vacuum channels located between the air passageway openings on the peripheral surface of the print drum. The heat source heats the peripheral surface of the print drum and the screen, the screen covering the peripheral surface of the drum and passing over the air passageways and the vacuum channels. In some embodiments, the screen is made of a first material and the peripheral surface of the print drum is made of a second material, and the first material and the second material have a similar coefficient of thermal expansion.

In other embodiments, the screen and the peripheral surface of the print drum are made of a material having the same coefficient of thermal expansion. The peripheral surface of the printing apparatus includes a media ejection channel separate from the air passageway openings in the peripheral surface of the print drum, and also includes a source of pressurized gas in fluid communication with the at media ejection channel. In some embodiments the media ejection channel and the source of pressurized gas are adapted to produce a force on media greater than the force produced by the vacuum source in fluid communication with the air passageway openings on the peripheral surface of the print drum. The source of pressurized gas includes a pressure nozzle directed at the media ejection channel. The pressure nozzle is positioned near the screen so that pressurized gas from the pressure nozzle is directed through the screen and into the media ejection channel.

A method for printing on media held to a print drum by a vacuum includes placing a screen over the print drum, holding a print medium onto the print drum with a vacuum, depositing ink on the print medium, and heating the print drum and the screen. The method also includes removing the print media from the print drum. In some embodiments, pressurizing a media ejection channel on the surface of the print drum is part of removing the print media from the print drum. Pressurizing the media ejection channel includes directing a stream of gas into the media ejection channel and through the screen over the print drum. The stream of gas is directed toward the area of the print drum near a leading edge of the media.

A printing apparatus includes a print drum having a plurality of openings therein, an apparatus for holding media onto the print drum, an apparatus for heating the print drum, and an apparatus for preventing defects on the media due to differences in a heat transfer rate of a surface of the print drum and a heat transfer rate of the plurality openings in the print drum. In one embodiment, the apparatus for substantially lessening a set of defects on the media due to differences in a heat transfer rate of a surface of the print drum and a heat transfer rate of the plurality openings in the print drum includes a screen placed on the surface of the print drum, the screen spanning the plurality of openings in the print drum. The printing apparatus also includes an apparatus for removing media from the print drum. In some embodiments, the apparatus for removing media from the print drum includes at least one media ejection channel on a surface of the print drum. The at least one media ejection channel is separate from the plurality of openings in the print drum. The apparatus for removing media from the print drum includes a nozzle for directing pressurized gas at a surface of the print drum forward of a leading edge of the media on the print drum. The apparatus for holding media onto the print drum includes a source of low pressure in fluid communication with the plurality of openings in the print drum and the apparatus for removing media from the print drum, in some embodiments, includes a device for disconnecting the source of low pressure from the plurality of openings in the print drum.

A printing apparatus has a paper path that includes a source of paper, a print drum having an outside surface having vacuum openings therein for temporarily holding paper onto the print drum as the paper is moved through a print zone. The print drum includes a device to substantially lessens defects resulting from the difference between the vacuum openings and the surface of the print drum. The paper path also includes a mechanism for moving paper from the source of paper to the print drum, and a device for removing paper from the print drum. The printing apparatus also includes a source of ink positioned to deposit ink on the paper when the paper is positioned in the print zone. The printing also includes a housing. The paper path and the source of ink are located substantially within the housing. The printing apparatus also includes a heat source for heating the print drum.

A printing apparatus includes a print drum having a peripheral surface, and a nozzle positioned near the peripheral surface of the print drum. The nozzle directs a stream of gas toward the print drum and adapted to remove a media carried by the print drum. The print drum is substantially cylindrically-shaped and includes an axis. The stream of gas makes an angle traversing a radial line through the axis of the print drum.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A printing apparatus comprising:

a drum having a peripheral surface, the peripheral surface having at least one passageway therein;

a screen placed over the peripheral surface of the drum, the screen having apertures therein that are smaller than the at least one passageway of the peripheral surface of the drum; and a heat source for heating the peripheral surface of the drum and the screen.

2. The printing apparatus of claim 1 wherein at least a portion of the heat source is inside the drum.

3. The printing apparatus of claim 1 further comprising a vacuum source, the vacuum source in fluid communication with the at least one passageway on the peripheral surface of the drum.

4. The printing apparatus of claim 3 wherein at least a portion of the vacuum source is inside the drum.

5. The printing apparatus of claim 3 further comprising a source of pressurized gas in fluid communication with the at least one passageway on the peripheral surface of the drum.

6. The printing apparatus of claim 5 further comprising a media ejector in fluid communication with the source of pressurized gas, the media ejector and the source of pressurized gas adapted to blow a gas into the at least one passageway.

7. The printing apparatus of claim 6 wherein the media ejector includes an internal cavity for directing a pressurized gas from the pressure source of gas through the screen and into the at least one passageway.

8. The printing apparatus of claim 6 wherein the media ejector has an end positioned near the at least one passageway on the drum.

9. The printing apparatus of claim 1 wherein the at least one passageway include channels located on the peripheral surface of the drum.

10. The printing apparatus of claim 1 further comprising a heat source for heating the peripheral surface of the drum and the screen, the screen covering the peripheral surface of the drum and passing over the at least one passageway.

11. The printing apparatus of claim 10 wherein the screen material has a coefficient of thermal expansion within the range of 1.0 to 30.0 micrometers/meter/degree Centigrade.

12. The printing apparatus of claim 10 wherein the screen and the peripheral surface of the drum are made of materials having a same coefficient of thermal expansion.

13. A method for printing on media comprising:

placing a screen over a drum;

holding a print medium onto the screen with a vacuum;

depositing ink on the print medium;

and directing a stream of gas from a conduit external to the drum through the screen and towards the drum.

14. The method of claim 13 further comprising heating the drum and the screen.

15. The method of claim 13 further comprising removing the media from the drum.

16. The method of claim 13 further comprising pressurizing a channel on the surface of the drum to remove the media from the drum.

17. The method of claim 16 wherein the pressurizing the channel includes directing a stream of gas through the screen and, into the channel and, the stream of gas directed toward an area of the drum near a leading edge of the media.

18. A printing apparatus comprising:

a drum having passageways therein;

a screen having apertures therein covering the drum;

means for holding media onto the screen; and means for heating the drum and screen.

19. The printing apparatus of claim 18 wherein means for holding media on to the screen includes producing a vacuum in the passageways of the drum.

20. The printing apparatus of claim 18 further comprising means for removing media from the drum.

21. The printing apparatus of claim 20 wherein means for removing media from the drum includes at least one media pick-off for pressurizing a passageway on the drum.

22. The printing apparatus of claim 18 wherein means for holding media onto the drum includes a source of low pressure in fluid communication with the passageways in the drum and wherein means for removing media from the drum includes means for disconnecting the source of low pressure from the plurality of passageways in the drum.

23. A printing apparatus comprising:

a media path having a print drum having an outside surface having at least one passageway;

a screen covering the print drum and the at least one passageway;

a conduit for blowing a gas through the screen and into the at least one passageway, the screen having apertures therein that allow the gas to be transmitted through the screen to the at least one passageway.

24. The printing apparatus of claim 23 including a vaccum source configured to temporarily hold media onto the screen as the media is moved through a print zone.

25. The printing apparatus of claim 23, wherein the conduit is configured such that media is removed from the screen when the gas from the conduit is blown into the at least one passageway.

26. The printing apparatus of claim 23 further comprising a housing, the media path and a source of ink being located substantially within the housing.

27. The printing apparatus of claim 23 further comprising a heat source for heating the print drum.

28. The printing apparatus of claim 27 further comprising means for lessening a print defect due to uneven heating of the media.

29. The printing apparatus of claim 23 wherein the screen spans the at least one passageway in the drum and has a sufficient thermal mass to evenly distribute heat to media.

30. A printing apparatus comprising:

a paint drum having a peripheral surface;

a screen over the peripheral surface of the print drum; and a conduit external to the print drum and positioned near the screen to direct a stream of gas through the screen and towards the print drum.

* * * * *

UNITED STATES PATENT AND TRADEMARK OFFICE

CERTIFICATE OF CORRECTION

PATENT NO. : 6,983,692 B2
APPLICATION NO. : 10/699447
DATED : January 10, 2006
INVENTOR(S) : Robert W. Beauchamp et al.

It is certified that error appears in the above-identified patent and that said Letters Patent is hereby corrected as shown below:

In column 2, line 37, delete "10" and insert -- 110 --, therefor.

In column 2, line 44, delete "10" and insert -- 110 --, therefor.

In column 2, line 56, delete "10" and insert -- 110 --, therefor.

In column 9, line 56, in Claim 17, before "into" delete "and," and insert -- and --, therefor.

In column 9, line 56, in Claim 17, after "channel" delete "and".

In column 10, line 31, in Claim 24, delete "vaccum" and insert -- vacuum --, therefor.

In column 10, line 50, in Claim 30, delete "paint" and insert -- print --, therefor.

Signed and Sealed this

Sixth Day of October, 2009

David J. Kappos

David J. Kappos
*Director of the United States Patent and Trademark Office*